US008061585B2

(12) United States Patent
Nikolai et al.

(10) Patent No.: US 8,061,585 B2
(45) Date of Patent: Nov. 22, 2011

(54) RECLOSABLE CARTONS

(75) Inventors: Dave M. Nikolai, Wausau, WI (US); Cheryl A. Preisig, Wausau, WI (US); Bernd A. Schneider, Schofield, WI (US); David M. Poverski, Wausau, WI (US); Michael D. Sweet, Penacook, NH (US)

(73) Assignee: Graphic Packaging International, Inc., Marietta, GA (US)

( * ) Notice: Subject to any disclaimer, the term of this patent is extended or adjusted under 35 U.S.C. 154(b) by 268 days.

(21) Appl. No.: 12/022,371

(22) Filed: Jan. 30, 2008

(65) Prior Publication Data

US 2008/0179385 A1 Jul. 31, 2008

Related U.S. Application Data

(60) Provisional application No. 60/887,268, filed on Jan. 30, 2007.

(51) Int. Cl.
*B65D 5/00* (2006.01)
*B65D 5/28* (2006.01)

(52) U.S. Cl. ..... 229/126; 229/198

(58) Field of Classification Search ..... 229/126, 229/198, 125.37, 125.28, 125.29
See application file for complete search history.

(56) References Cited

U.S. PATENT DOCUMENTS

| | | | | |
|---|---|---|---|---|
| 692,990 | A * | 2/1902 | Davis | 229/125.41 |
| 762,966 | A * | 6/1904 | Webb | 229/152 |
| 1,317,162 | A | 9/1919 | Heppe | |
| 1,501,016 | A | 7/1924 | Young | |
| D115,651 | S | 7/1939 | Ford et al. | |
| D120,673 | S | 5/1940 | Jung | |
| 2,348,378 | A | 5/1944 | Goodyear | |
| 2,355,729 | A * | 8/1944 | Inman | 229/117.14 |
| 2,355,730 | A * | 8/1944 | Inman | 229/114 |
| 2,372,747 | A | 4/1945 | Sullivan | |
| 2,419,510 | A | 4/1947 | Rosen | |
| 2,586,301 | A | 2/1952 | Castle | |
| 2,643,811 | A | 6/1953 | Bolding | |
| 2,794,585 | A | 6/1957 | Wagner | |
| 2,894,673 | A | 7/1959 | Vuillemenot | |
| 3,013,710 | A | 12/1961 | Kronson et al. | |
| 3,144,191 | A | 8/1964 | Saidel | |
| 3,257,027 | A | 6/1966 | Weiss | |
| 3,322,263 | A | 5/1967 | Gulliver | |
| 3,389,850 | A | 6/1968 | Rockefeller | |
| 3,471,006 | A | 10/1969 | Tempelhof | |
| 3,493,104 | A | 2/1970 | Tempelhof | |
| 3,640,380 | A | 2/1972 | Huffman | |
| 3,679,093 | A | 7/1972 | Chang | |
| 3,987,893 | A | 10/1976 | Hanson | |
| D242,901 | S | 1/1977 | Lohrbach | |
| 4,007,869 | A | 2/1977 | Stolkin et al. | |
| 4,185,765 | A | 1/1980 | McLaren | |
| 4,230,261 | A | 10/1980 | Austin | |
| 4,238,069 | A | 12/1980 | Morris | |

(Continued)

FOREIGN PATENT DOCUMENTS

EP 611702 A1 * 8/1994

(Continued)

*Primary Examiner* — Nathan J Newhouse
*Assistant Examiner* — Christopher Demeree
(74) *Attorney, Agent, or Firm* — Womble Carlyle Sandridge & Rice, LLP

(57) ABSTRACT

Cartons have reclosable lids that allow items to be placed in and removed from the cartons.

10 Claims, 14 Drawing Sheets

U.S. PATENT DOCUMENTS 4,355,758 A 10/1982 Lavery
4,397,393 A 8/1983 Pergande et al.
4,471,904 A 9/1984 Cassidy
4,530,459 A 7/1985 Maroszek
4,535,928 A 8/1985 Capo
4,548,352 A 10/1985 Capo et al.
4,601,390 A 7/1986 Rosenthal et al.
D293,212 S 12/1987 Zuliani
4,721,243 A 1/1988 Mercurio
4,782,788 A 11/1988 Arcand
4,930,637 A 6/1990 DeRoseau
4,969,596 A 11/1990 Schulbaum
5,020,337 A 6/1991 Krieg
D319,388 S 8/1991 McIntosh, Jr. et al.
5,042,715 A 8/1991 McNeill
5,060,850 A 10/1991 Weaver
5,240,174 A 8/1993 Wenninger
5,275,331 A 1/1994 Chung-Piao
5,299,734 A 4/1994 Lane
5,375,700 A 12/1994 Joss et al.
5,379,886 A 1/1995 Brauner et al.
5,392,984 A 2/1995 Yocum
5,400,901 A 3/1995 Harrelson
5,413,273 A 5/1995 Money
5,423,478 A 6/1995 Roosa
5,431,333 A * 7/1995 Lorenz ..... 229/114
5,458,235 A 10/1995 Stone
5,458,270 A 10/1995 Tsao
5,501,335 A 3/1996 Harris
5,524,814 A 6/1996 Davis
D371,965 S 7/1996 Kinni
5,540,330 A 7/1996 Lo Duca
D373,079 S 8/1996 Fahlen
5,551,556 A 9/1996 Sutherland
5,566,878 A 10/1996 Peiffer et al.
5,595,291 A 1/1997 Negelen
5,607,058 A 3/1997 Huesman et al.
5,620,134 A 4/1997 Gulliver
D386,078 S 11/1997 Harper et al.
D386,680 S 11/1997 Johnson
5,685,478 A 11/1997 Tang
D396,805 S 8/1998 Broyles
5,853,121 A 12/1998 Francisco
5,907,944 A 6/1999 Giacoman
5,927,593 A 7/1999 Berkowitz et al.
5,950,912 A 9/1999 Economopoulos
D418,751 S 1/2000 Wolf
6,036,085 A 3/2000 Tsao
D425,413 S 5/2000 Heeley et al.
D427,524 S 7/2000 Weisz
6,108,982 A 8/2000 Davison
D430,610 S 9/2000 Jones
6,116,421 A 9/2000 Collins
6,173,833 B1 1/2001 Strehlow
6,189,687 B1 2/2001 Bakx
6,189,776 B1 2/2001 Smith et al.
6,206,750 B1 3/2001 Barad et al.
D440,488 S 4/2001 Thompson et al.
D446,113 S 8/2001 Steinfels
6,290,123 B1 9/2001 Pei
6,298,990 B1 10/2001 Amrod et al.
D449,979 S 11/2001 Planchard
6,439,452 B1 8/2002 Tsao
D463,274 S 9/2002 Green
D464,878 S 10/2002 Thompson
6,470,653 B1 10/2002 Lutz et al.
6,474,539 B1 11/2002 Van Der Horst
6,530,516 B1 3/2003 Ritter
6,581,823 B1 6/2003 De Beck
D479,853 S 9/2003 Hwang et al.
6,644,473 B2 11/2003 Kohler
6,679,029 B2 1/2004 Clay
D488,062 S 4/2004 Shannon
6,802,415 B2 10/2004 Loeffler
6,823,988 B2 11/2004 Ryan et al.
6,837,420 B2 1/2005 Westerman et al.
6,935,509 B2 8/2005 Egresitz
D525,866 S 8/2006 Oliveira
D532,690 S 11/2006 Oliveira
2001/0004088 A1 6/2001 Lau
2002/0070268 A1 6/2002 Schultz
2002/0088730 A1 7/2002 Galomb
2003/0111521 A1 6/2003 Holmes
2003/0213705 A1 11/2003 Woog
2004/0163986 A1 8/2004 Pinyot
2006/0091190 A1 5/2006 Nikolai
2006/0254954 A1 11/2006 Wright
2007/0000980 A1 1/2007 Oliveira

FOREIGN PATENT DOCUMENTS

EP 0 639 504 A1 2/1995
GB 889718 2/1962
SE 140 388 5/1953

* cited by examiner

RECLOSABLE CARTONS

PRIORITY APPLICATION

This application claims the benefit of U.S. Provisional Application No. 60/887,268, filed Jan. 30, 2007, which application is incorporated by reference as if set forth herein in its entirety.

SUMMARY

According to one embodiment of the present invention, a carton comprises a base panel, a first side panel, a second side panel, a first end panel, a second end panel, and one or more hingedly attached cover panels.

According to one aspect of the present invention, a carton can include a single cover panel that engages a closure feature on a side panel to place the carton in a closed configuration.

According to another aspect of the present invention, a carton includes a first cover panel and a second cover panel, each cover panel having a closure feature that allows the cover panels to be secured together to place the carton in a closed configuration.

According to the above-described embodiments, the cartons may be formed from one-piece blanks, which reduces complexity of manufacture. The cartons can be closed and remain in secured, closed configurations. The cover panels allow for easy opening, filling, closing, and reclosing of the cartons. The cartons may be stackable when in their open, erected configurations, and when in their closed configurations.

Other aspects, features, and details of the present invention can be more completely understood by reference to the following detailed description of exemplary embodiments taken in conjunction with the drawings and from the appended claims.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

Figure 1:
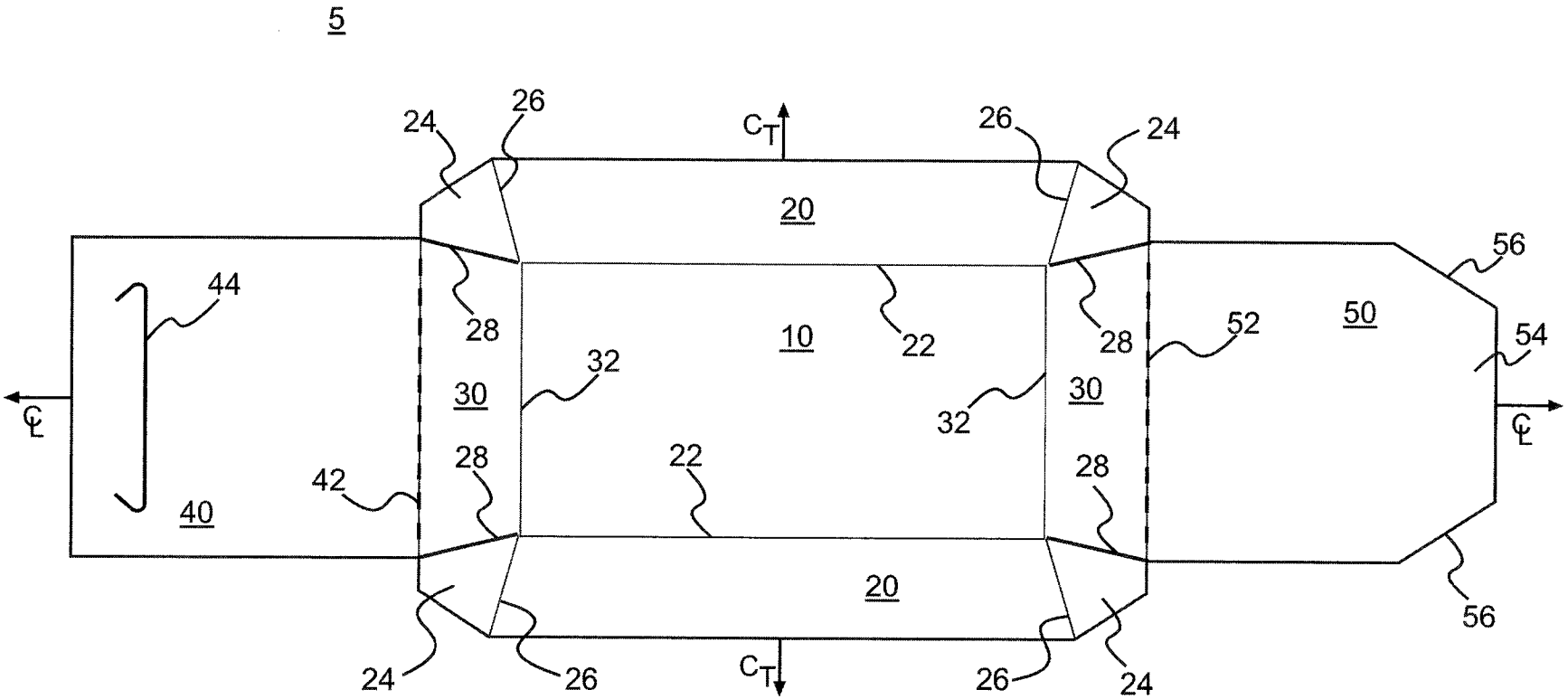
FIG. 1 is a plan view of a blank from which a carton according to a first embodiment of the invention may be formed.

FIG. 1 is a plan view of a blank 5 used to form a reclosable carton 95 according to a first embodiment of the invention. The carton 95 is illustrated in its erected, open configuration in FIG. 3, and in its closed configuration in FIG. 4. As shown in FIG. 1, the blank 5 may be wholly or partially symmetric about a transverse centerline $C_T$ and about a longitudinal centerline $C_L$. Therefore, certain elements in the drawing figures share common reference numerals in order to reflect the whole and/or partial symmetries.

In this specification, the relative terms "lower" and "upper" indicate orientations determined in relation to fully erected cartons supported on a base panel. The terms "end" and "side" are not intended to convey any relative size difference between end panels and side panels except as specifically recited in the appended claims.

Referring to FIG. 1, the blank 5 comprises a base panel 10 foldably connected to first and second side panels 20 at longitudinal fold lines 22, first and second end panels 30 foldably connected to the base panel 10 at transverse fold lines 32, a first cover panel 40 foldably connected to one end panel 30 at a transverse fold line 42, and a second cover panel 50 foldably connected to the other end panel 30 at a transverse fold line 52. An adhesive flap 24 may be foldably connected to each end of each side panel 20 at an oblique fold line 26. The ends of the adhesive flaps 24 are separated from adjacent end panels 30 at oblique breachable lines of disruption 28, which may be, for example, cuts.

The second cover panel 50 includes a closure projection 54 projecting from a distal end of the cover panel 50. The closure projection 54 is defined in part by angled or beveled edges 56. In the erected carton 95 (illustrated in FIG. 4), the closure projection 54 is sized to be received in a closure aperture 44 formed in the first cover panel 40. The closure aperture 44 can be defined by, for example, a cut or slit in the first cover panel 40, or a cutout or breachable section of the cover panel 40.

In the exemplary embodiment, the fold lines 22, 26, 32 are crease lines and the fold lines 42, 52 are cut-space lines with 100% cuts, although other lines of disruption in the blank, such as cut-crease lines, may be used. The closure aperture 44 is illustrated as a continuous cut, although it may be interrupted by nicks, for example.

An exemplary method of erection of the blank 5 into the carton 95, and closure of the top of the erected carton 95, will now be discussed with reference to FIGS. 1-4.

Figure 2:
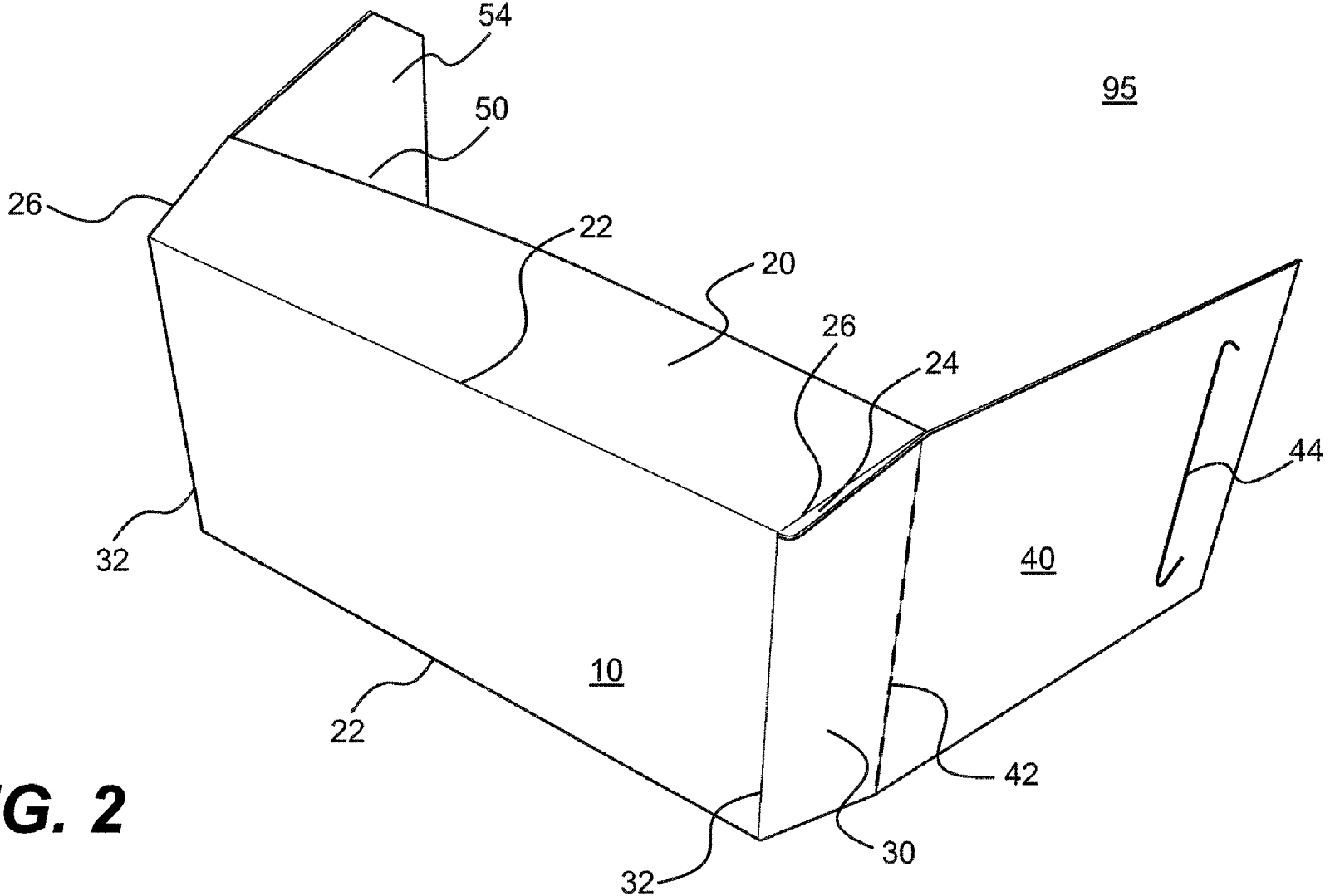
FIG. 2 illustrates the carton according to the first embodiment in a partially erected state.

Referring to FIGS. 1 and 2, the carton 95 may be erected from the blank 5 by folding the adhesive flaps 24 inwardly at the oblique fold lines 26, folding the side panels 20 upwardly about the longitudinal fold lines 22, and folding the end panels 30 upwardly about the transverse fold lines 32. The exterior sides of the adhesive flaps 24 can then be glued or otherwise adhered or secured to the interior sides of adjacent end panels 30.

Figure 3:
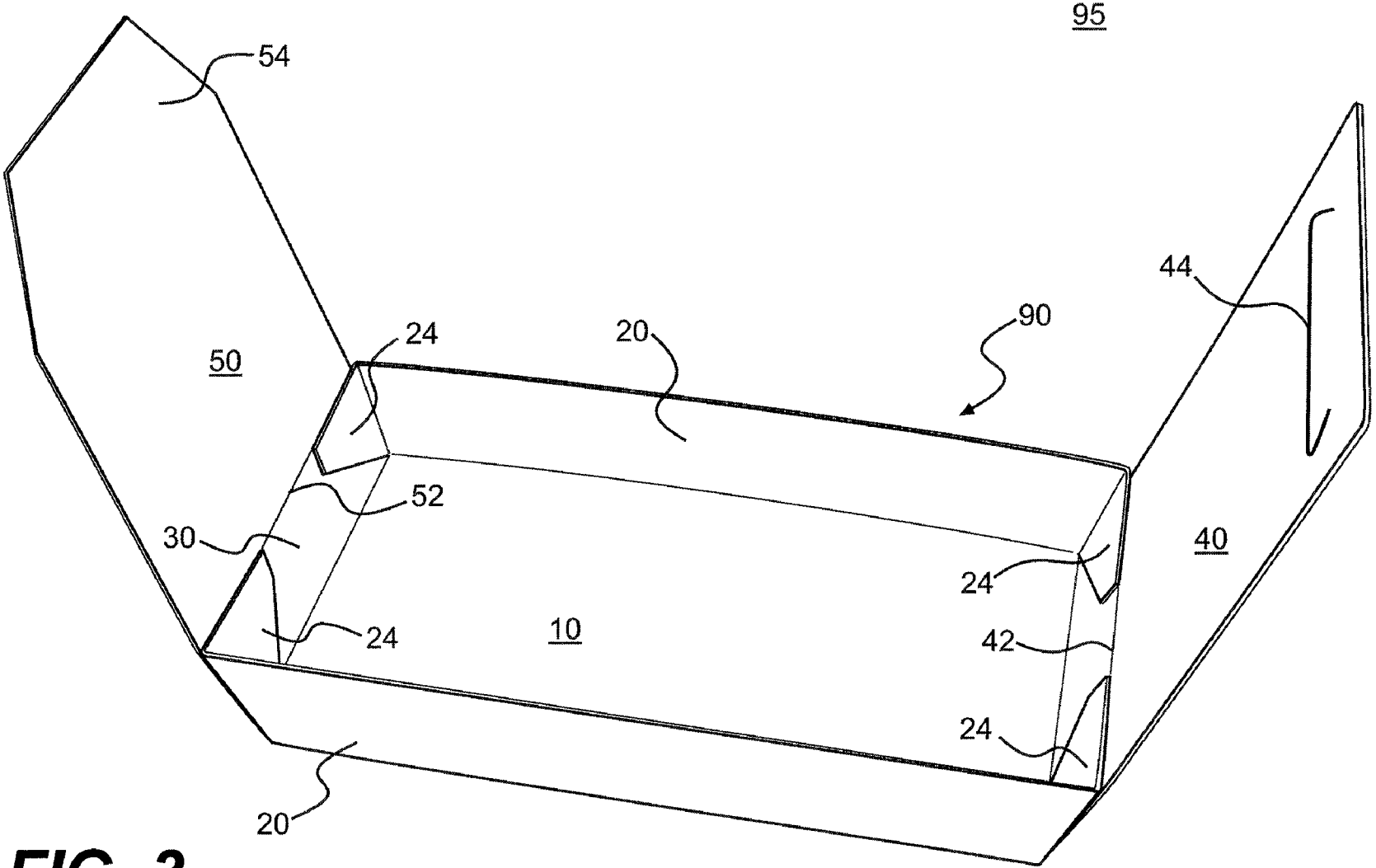
FIG. 3 illustrates the erected first carton embodiment in its opened configuration.

FIG. 3 illustrates the erected carton 95 in its upright, opened state. The panels 10, 20, 30 form a receptacle or "tray" portion 90 of the carton 95. The side and end panels 20, 30 may extend generally upwardly and obliquely (i.e., at a non-vertical orientation) with respect to the horizontal base panel 10, so that a surface area of the top opening of the receptacle 90 is larger than the surface area of the base panel 10.

Figure 4:
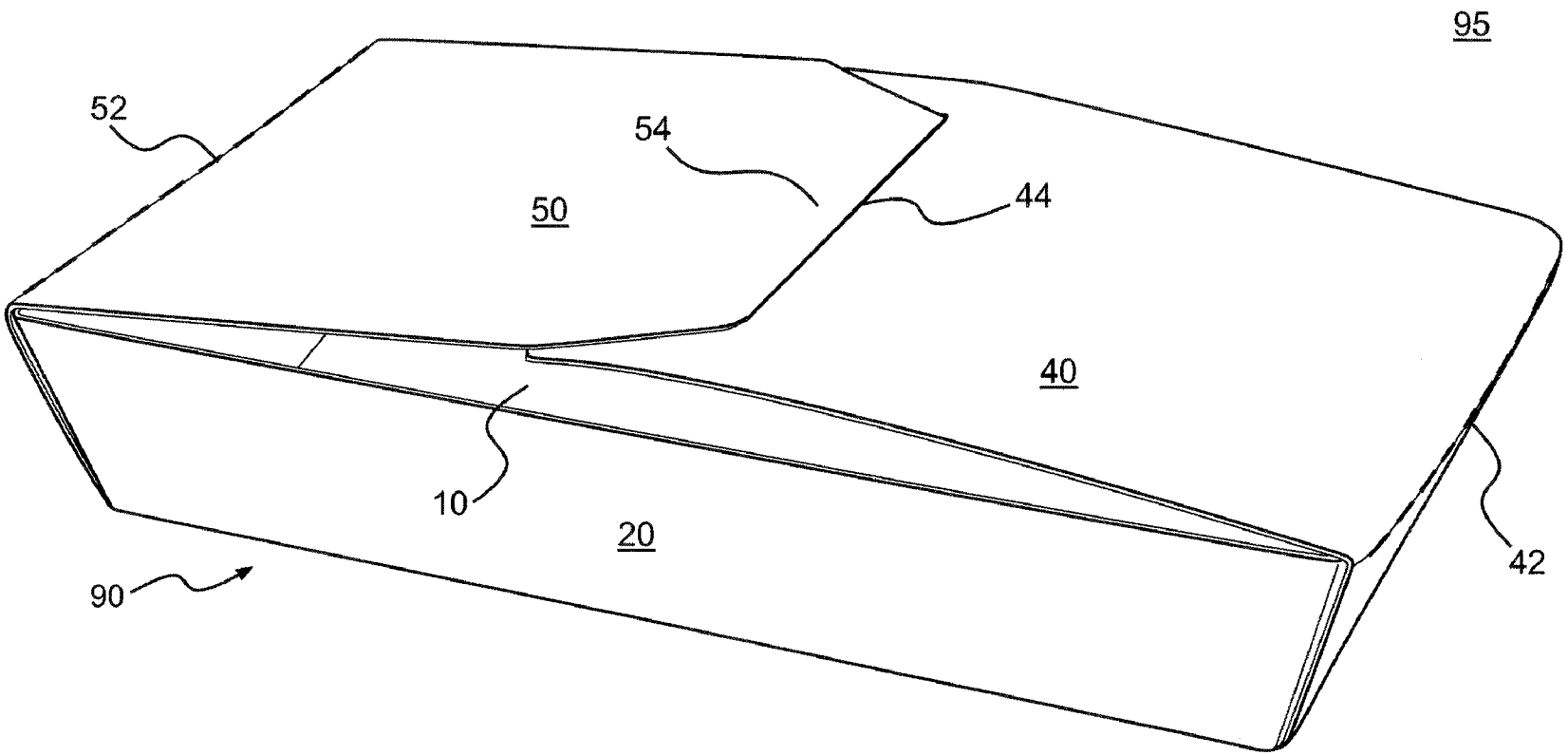
FIG. 4 illustrates the first carton embodiment in its closed configuration.

When closing the carton 95, the transverse fold lines 42, 52 act as hinge or pivot lines for the first and second cover panels 40, 50, respectively. The tray portion 90 of the carton 95 is covered by pivoting the first cover panel 40 downwardly about the transverse hinge line 42 and pivoting the second cover panel 50 downwardly about the transverse hinge line 52. Referring to FIG. 4, the carton 95 is secured in its closed configuration by pressing the closure projection 54 of the second cover panel 50 into the closure aperture 44 formed in the first cover panel 40. The first and second cover panels 40, 50 are joined such that the top of the closed carton 95 has a relatively flat profile. The carton 95 may be subsequently opened and reclosed by disengaging and reengaging the closure projection 54 with the closure aperture 44.

Figure 5:
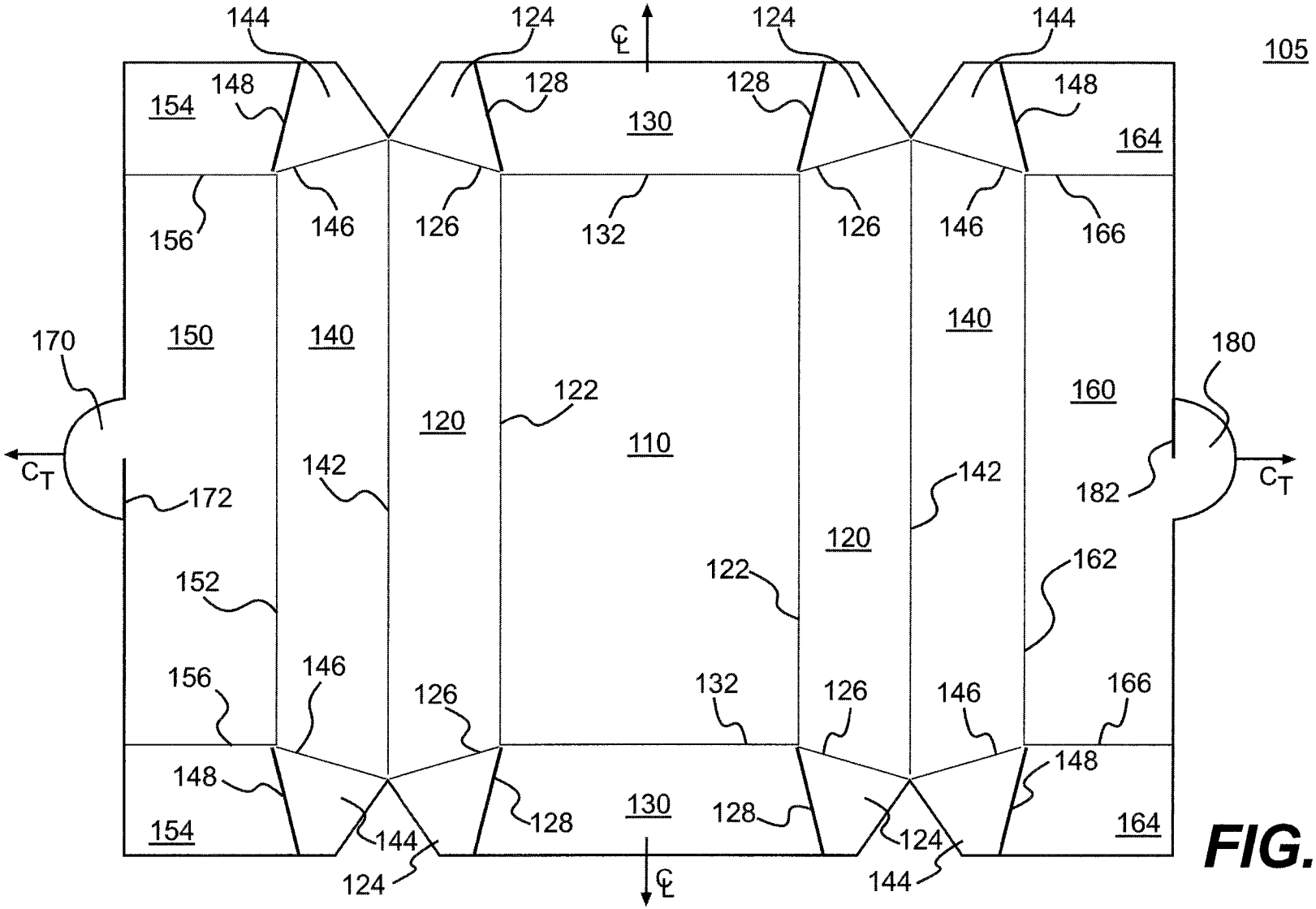
FIG. 5 is a plan view of a blank from which a carton according to a second embodiment of the invention may be formed.

FIG. 5 is a plan view of a blank 105 used to form a reclosable carton 195 according to a second embodiment of the invention. The carton 195 is illustrated in its erected, open configuration in FIG. 7, and in its closed configuration in FIG. 8. As shown in FIG. 5, the blank 105 may be wholly or partially symmetric about a transverse centerline $C_T$ and about a longitudinal centerline $C_L$. Therefore, certain elements in the drawing figures share common reference numerals in order to reflect the whole and/or partial symmetries.

Referring to FIG. 5, the blank 105 comprises a base panel 110 foldably connected to first and second lower side panels 120 at longitudinal fold lines 122, first and second end panels 130 foldably connected to the base panel 110 at transverse fold lines 132, and first and second upper side panels 140 foldably connected to the first and second lower side panels 120 at longitudinal fold lines 142. A first cover panel 150 is foldably connected to one upper side panel 140 at a transverse fold line 152, and a second cover panel 160 is foldably connected to the other upper side panel 140 at a transverse fold line 162.

A lower adhesive flap 124 may be foldably connected to each end of each lower side panel 120 at an oblique fold line 126. The ends of the lower adhesive flaps 124 are separated from adjacent end panels 130 at oblique breachable lines of disruption 128, which may be, for example, cuts. An upper adhesive flap 144 may be foldably connected to each end of each upper side panel 140 at an oblique fold line 146. First upper end flaps 154 are connected to each end of the first cover panel 150 at transverse fold lines 156, and second upper end flaps 164 are connected to each end of the second cover panel 160 at transverse fold lines 166. The ends of the upper adhesive flaps 144 are separated from adjacent upper end flaps 154, 164 at oblique breachable lines of disruption 148, which may be, for example, cuts.

The first cover panel 150 includes a first closure projection 170 projecting from the first cover panel 150. The first closure projection 170 is defined in part by a longitudinal breachable line of disruption 172 at the base of the closure projection 170. The second cover panel 160 includes a second closure projection 180 projecting from the second cover panel 160. The second closure projection 180 is defined in part by a longitudinal breachable line of disruption 182 at the base of the projection 180. In the erected carton 195 (illustrated in FIG. 8), the closure projections 170, 180 engage one another and interlock with one another at the breachable lines of disruption 172, 182.

In the exemplary embodiment, the fold lines 122, 126, 132, 142, 146, 156, 162, 166 are crease lines and the breachable lines of disruption 128, 148 are 100% cuts, although other lines of disruption in the blank may be used. The breachable lines of disruption 128, 148, 172, 182 are illustrated as a continuous cuts, although they may be interrupted by nicks, for example.

An exemplary method of erection of the blank 105 into the carton 195, and closure of the top of the erected carton 195, will now be discussed with reference to FIGS. 5-8.

Figure 6:
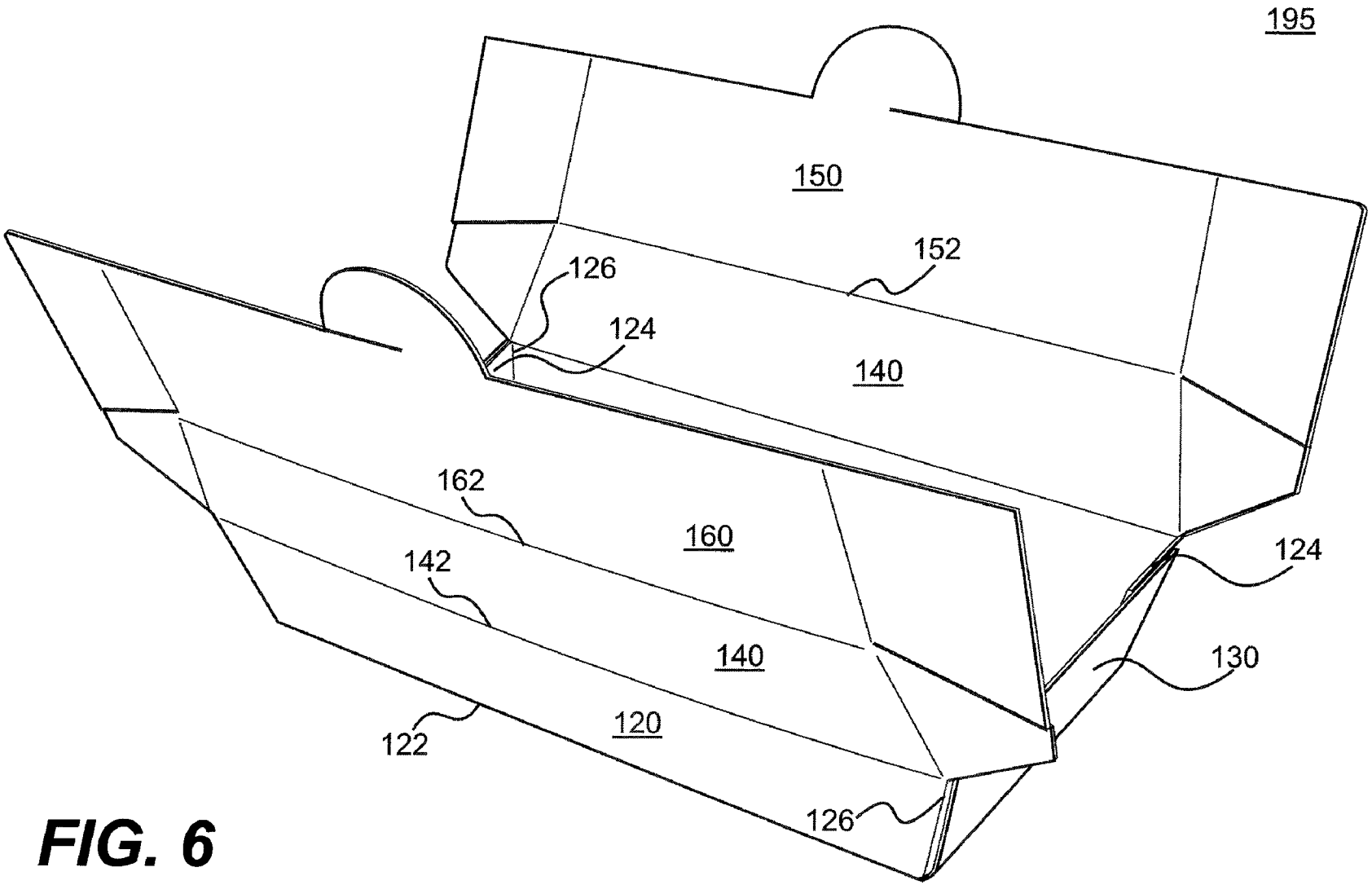
FIG. 6 illustrates the carton according to the second embodiment in a partially erected state.

Referring to FIGS. 5 and 6, the carton 195 may be erected from the blank 105 by folding the lower adhesive flaps 124 inwardly at the oblique fold lines 126, folding the lower side panels 120 upwardly about the longitudinal fold lines 122, and folding the end panels 130 upwardly about the transverse fold lines 132. The exterior sides of the lower adhesive flaps 124 can then be glued or otherwise adhered to the interior sides of adjacent end panels 130.

Figure 7:
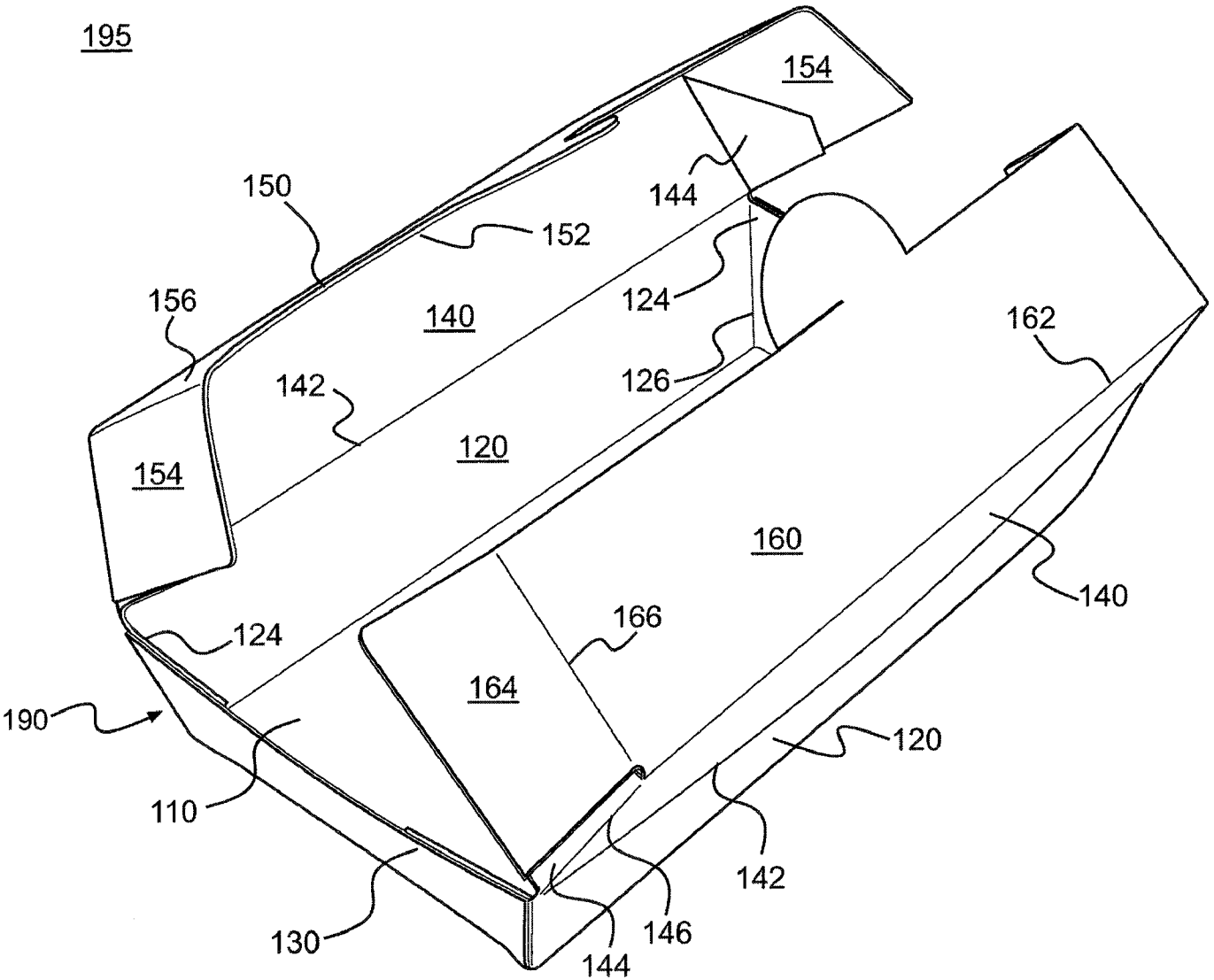
FIG. 7 illustrates the erected second carton embodiment in its opened configuration.

Referring to FIG. 7, the upper adhesive flaps 144 are folded inwardly about the oblique fold lines 146, and the first and second cover panels 150, 160 are folded inwardly about the longitudinal fold lines 152, 162, respectively. The first upper end flaps 154 are folded about the fold lines 156 so that they can be adhered to adjacent upper adhesive flaps 144, and the second upper end flaps 164 are folded about the fold lines 166 so that they can be adhered to adjacent upper adhesive flaps 144.

FIG. 7 illustrates the erected carton 195 in its upright, opened state. The panels 110, 120, 130 form a receptacle or tray portion 190 of the carton 195. The panels 120, 130 may generally extend upwardly obliquely (i.e., at a non-vertical orientation) with respect to the horizontal base panel 110, so that a surface area of the top of the receptacle 190 is larger than the surface are of the base panel 110. When closing the carton 195, the longitudinal fold lines 142 act as hinge or pivot lines for the first and second cover panels 150, 160 and the upper side panels 140. The open top of the tray portion 190 of the carton 195 is covered by pivoting the upper side panels 140 downward about the longitudinal fold lines 142 so that the first and second cover panels 150, 160 come together.

Figure 8:
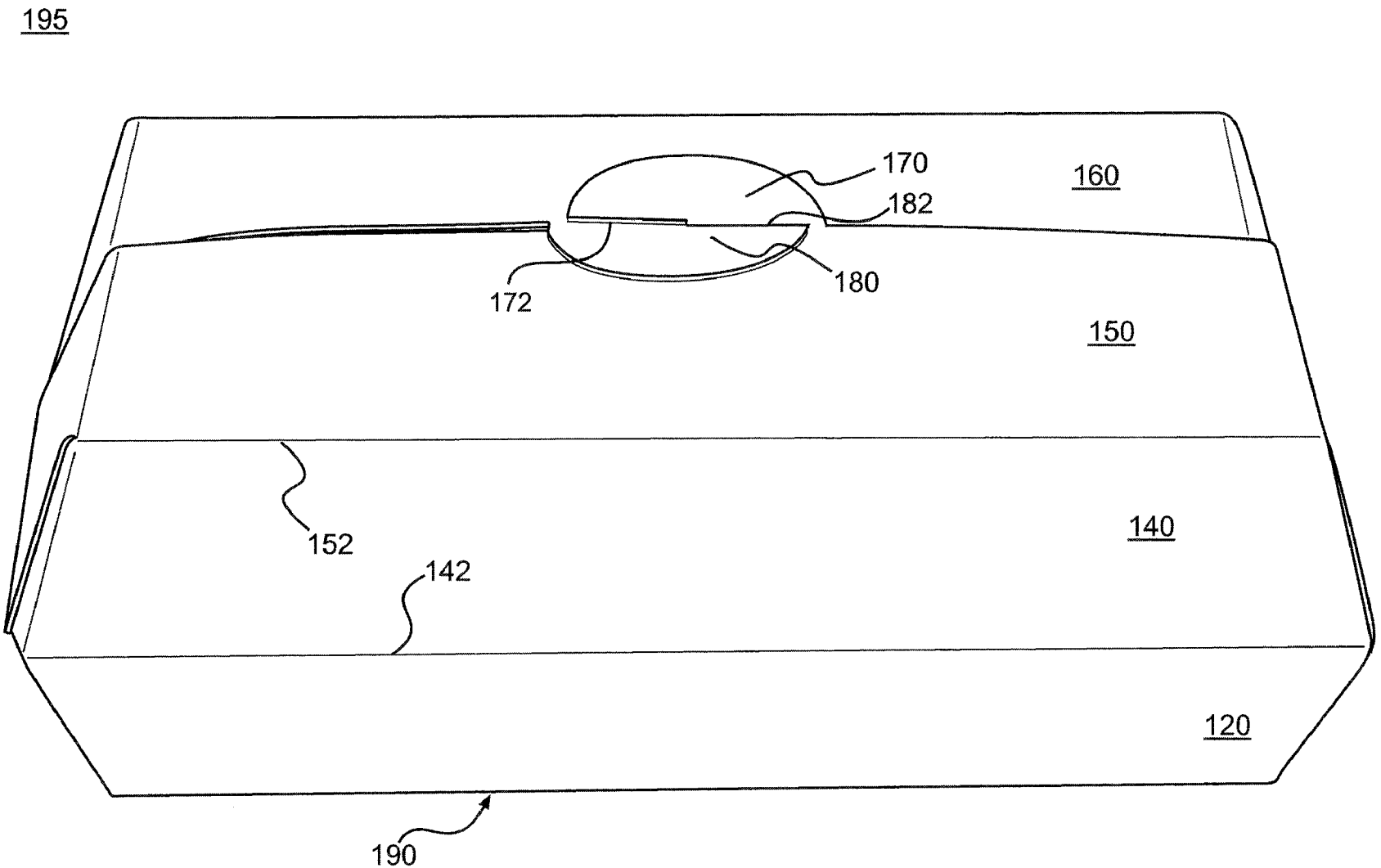
FIG. 8 illustrates the second carton embodiment in its closed configuration.

Referring to FIG. 8, the carton 195 is secured in its closed configuration by pressing the first closure projection 170 of the first cover panel 150 into engagement with the cut 182 at the base of the closure projection 180 in the second cover panel 160, and at the same time pressing the second closure projection 180 into engagement with the cut 172 at the base of the opposite closure projection 170. The first and second cover panels 150, 160 are joined such that the top of the closed carton 195 has a relatively flat profile. The carton 195 may be subsequently opened and reclosed by disengaging and reengaging the closure projections 170, 180.

Figure 9:
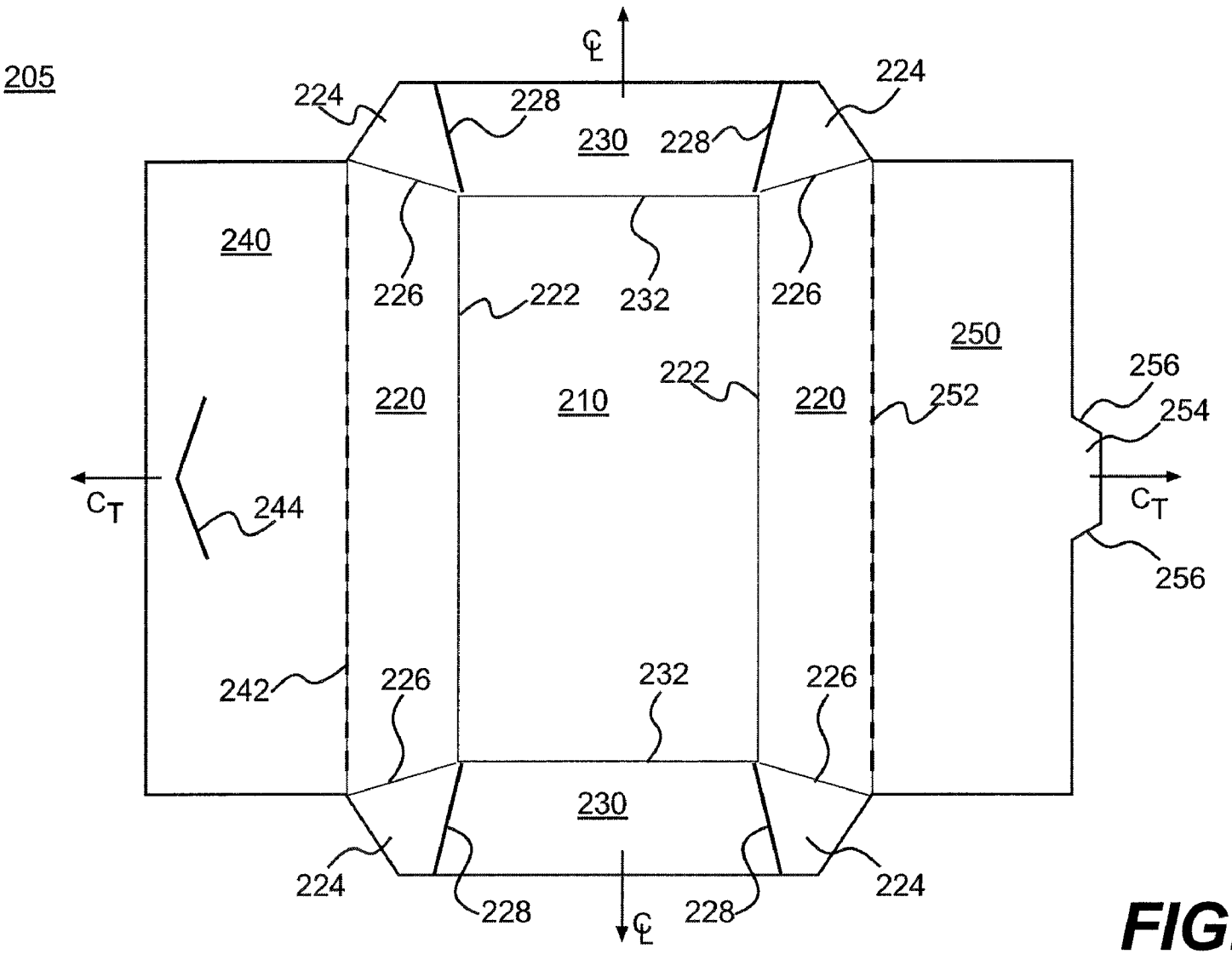
FIG. 9 is a plan view of a blank from which a carton according to a third embodiment of the invention may be formed.

FIG. 9 is a plan view of a blank 205 used to form a carton 295 according to a third embodiment of the invention. The carton 295 is illustrated in its erected, open configuration in FIG. 10, and in its closed configuration in FIG. 11. As shown in FIG. 9, the blank 205 may be wholly or partially symmetric about a transverse centerline $C_T$ and a longitudinal centerline $C_L$. Therefore, certain elements in the drawing figures share common reference numerals in order to reflect the whole and/or partial symmetries.

Referring to FIG. 9, the blank 205 comprises a base panel 210 foldably connected to first and second side panels 220 at longitudinal fold lines 222, first and second end panels 230 foldably connected to the base panel 210 at transverse fold lines 232, a first cover panel 240 foldably connected to one side panel 220 at a longitudinal fold line 242, and a second cover panel 250 foldably connected to the other side panel 220 at a longitudinal fold line 252. An adhesive flap 224 may be foldably connected to each end of each side panel 220 at an oblique fold line 226. The ends of the adhesive flaps 224 are separated from adjacent end panels 230 at oblique breachable lines of disruption 228, which may be, for example, cuts.

The second cover panel 250 includes a closure projection 254 projecting from one end of the cover panel 250. The closure projection 254 is defined in part by beveled or angled edges 256. In the erected carton 295 (FIG. 11), the closure projection 254 is sized to be received in a closure aperture 244 formed in the first cover panel 240. The closure aperture 244 can be defined by, for example, a cut or slit in the first cover panel 240, or a cutout or breachable section of the cover panel 240. The closure aperture 244 has a general open "V" shape.

In the exemplary embodiment, the fold lines 222, 226, 232 are crease lines, the fold lines 242, 252 are cut-space lines with 100% cuts, and the breachable lines of disruption 228 are 100% cuts, although other lines of disruption in the blank may be used. The breachable lines of disruption 228, 244 are illustrated as a continuous cuts, although they may be interrupted by nicks, for example.

An exemplary method of erection of the blank 205 into the carton 295, and closure of the erected carton 295, will now be discussed with reference to FIGS. 9-11.

Figure 10:
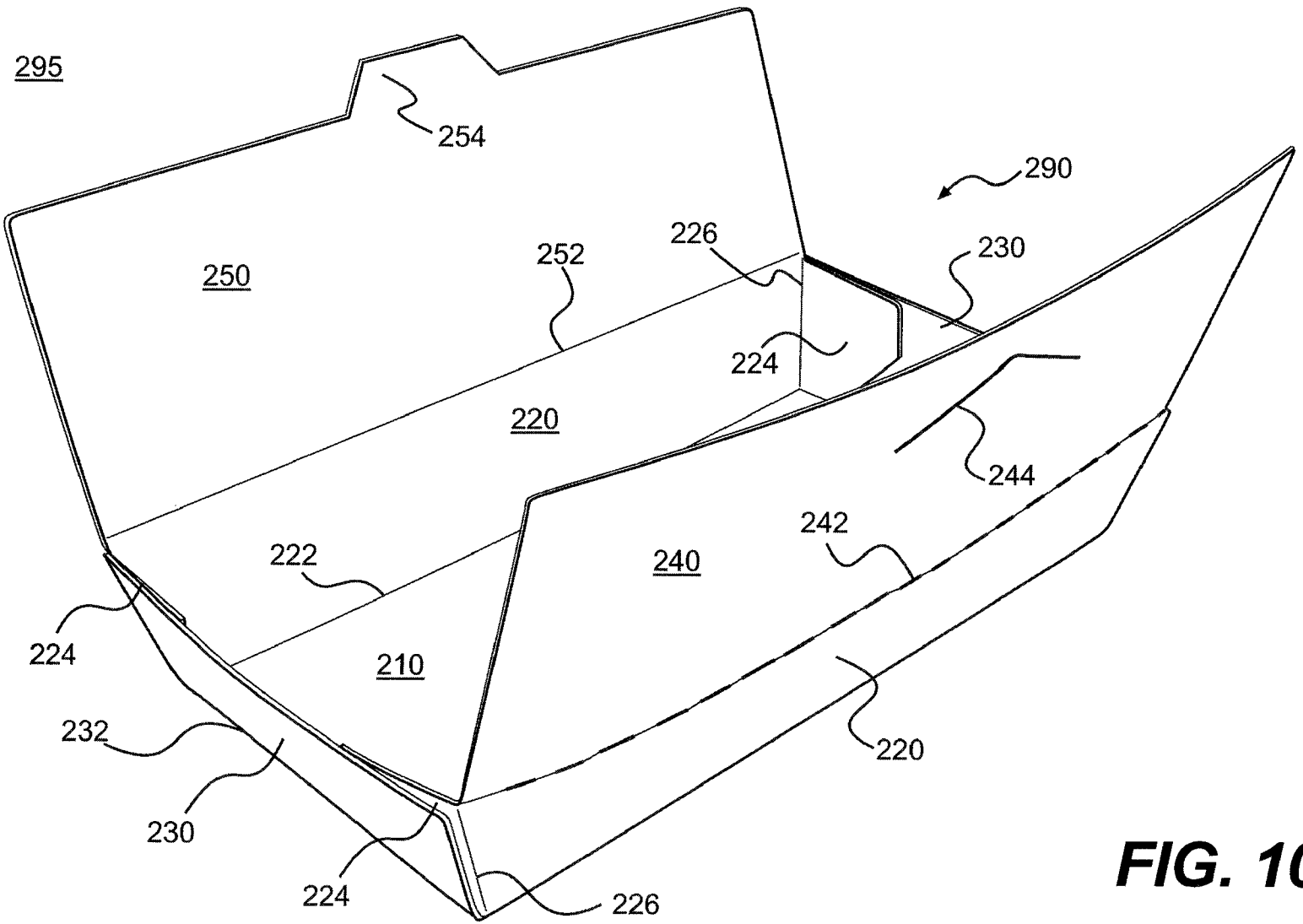
FIG. 10 illustrates the erected third carton embodiment in its opened configuration.

Referring to FIGS. 9 and 10, the carton 295 may be erected from the blank 205 by folding the adhesive flaps 224 inwardly at the oblique fold lines 226, folding the side panels 220 upwardly about the longitudinal fold lines 222, and folding the end panels 230 upwardly about the transverse fold lines 232. The exterior sides of the adhesive flaps 224 can then be glued or otherwise adhered or secured to the interior sides of adjacent end panels 230.

FIG. 10 illustrates the erected carton 295 in its upright, opened state. The panels 210, 220, 230 form a receptacle or tray portion 290 of the carton 295. The panels 220, 230 may extend generally upwardly and obliquely (i.e., at a non-vertical orientation) with respect to the horizontal base panel 210, so that a surface area of the top of the receptacle 290 is larger than the surface are of the base panel 210. When closing the carton 295, the longitudinal fold lines 242, 252 act as hinge or pivot lines for the cover panels 240, 250, respectively. The tray portion 290 of the carton 295 is covered by pivoting the first cover panel 240 downward about the longitudinal hinge line 242 and pivoting the second cover panel 250 downward about the longitudinal hinge line 252.

Figure 11:
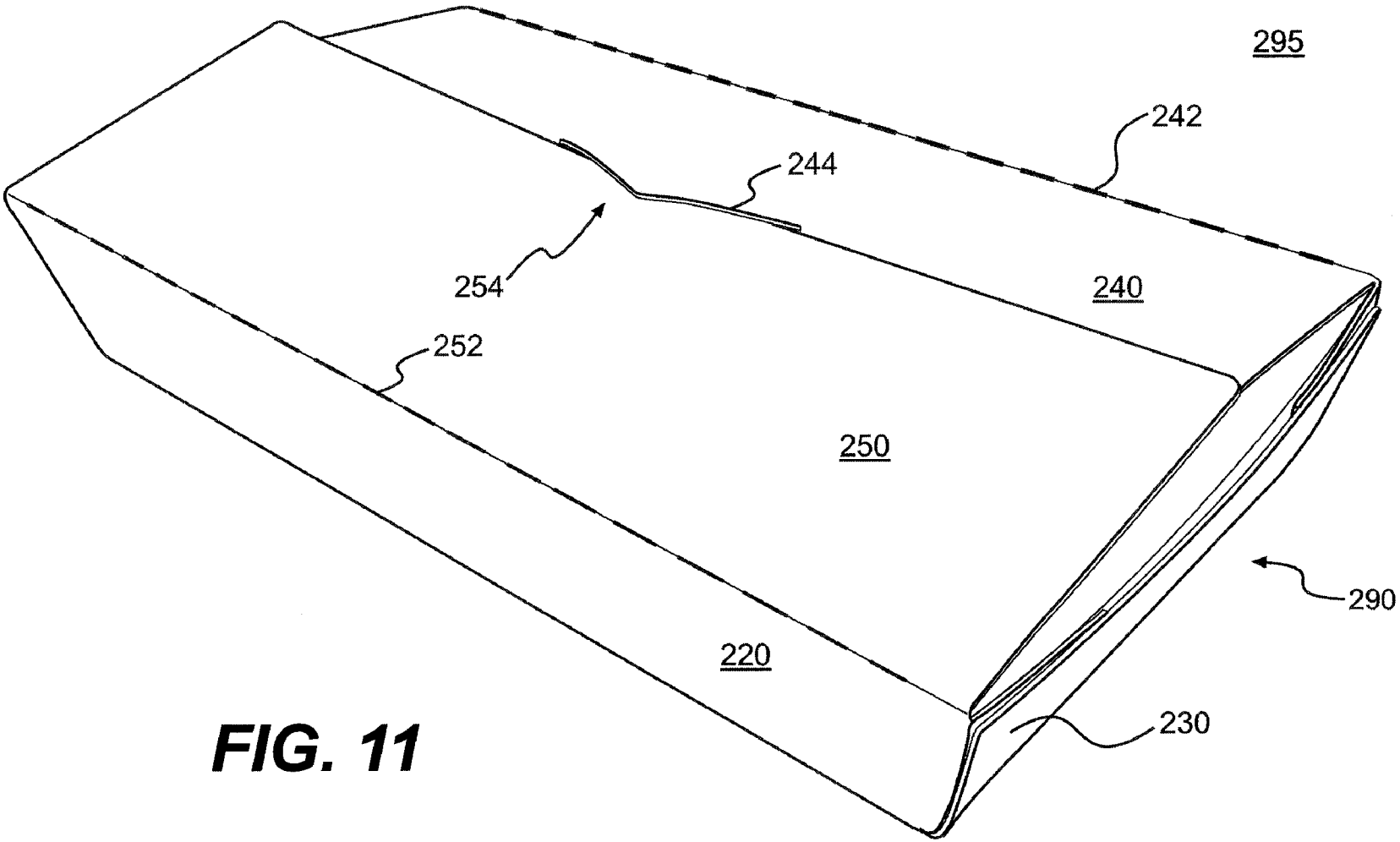
FIG. 11 illustrates the third carton embodiment in its closed configuration.

Referring to FIG. 11, the carton 295 is secured in its closed configuration by pressing the closure projection 254 of the second cover panel 250 into the closure aperture 244 in the first cover panel 240. The first and second cover panels 240, 250 are joined such that the top of the closed carton 295 has a relatively flat profile. The carton 295 may be subsequently opened and reclosed by disengaging and reengaging the closure projection 254 with the closure aperture 244.

Figure 12:
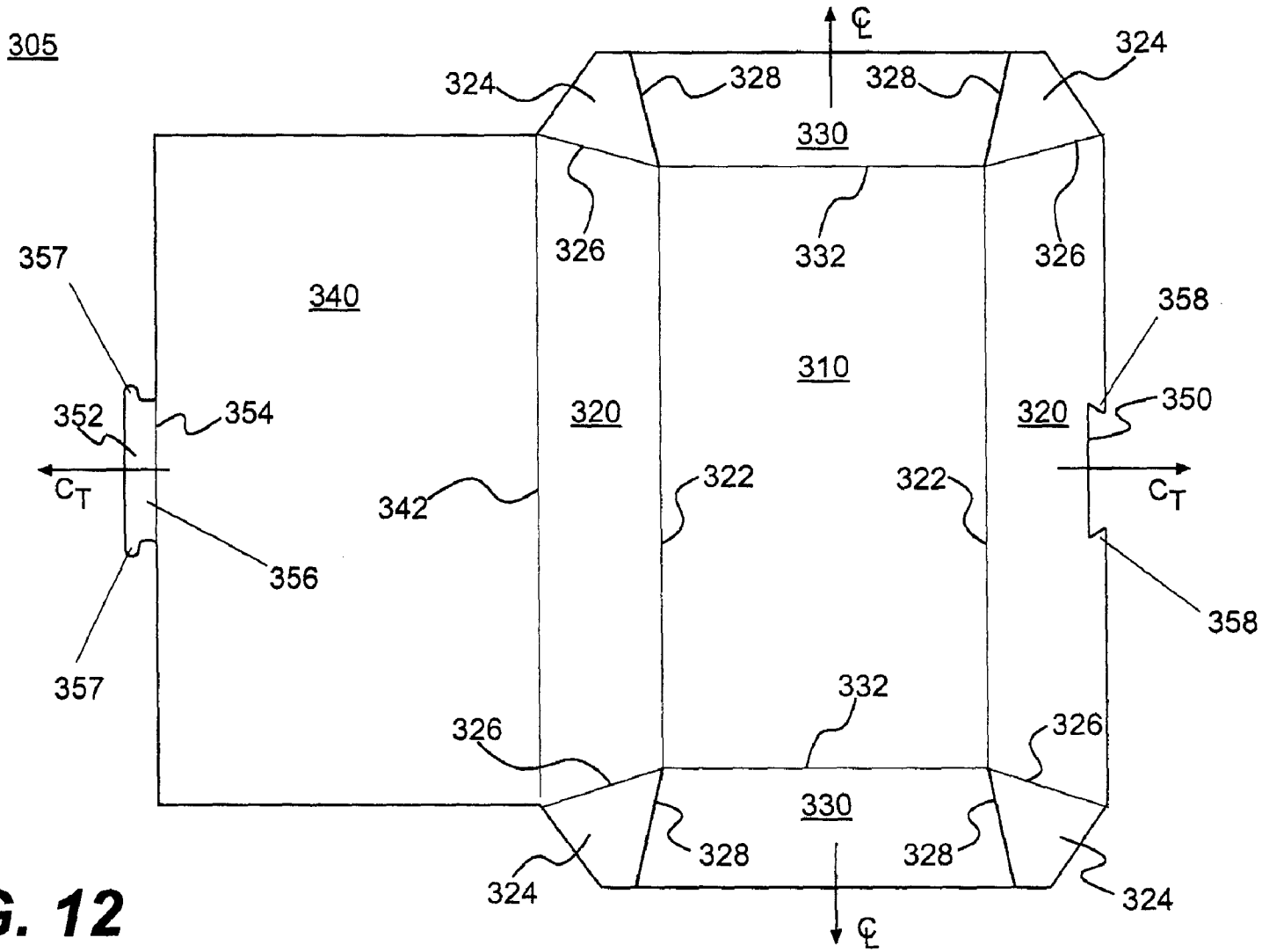
FIG. 12 is a plan view of a blank from which a carton according to a fourth embodiment of the invention may be formed.

FIG. 12 is a plan view of a blank 305 used to form a carton 395 according to a fourth embodiment of the invention. The carton 395 is illustrated in its erected, open configuration in FIG. 13, and in its closed configuration in FIG. 14. As shown in FIG. 12, the blank 305 may be wholly or partially symmetric about a transverse centerline $C_T$ and a longitudinal centerline $C_L$. Therefore, certain elements in the drawing figures share common reference numerals in order to reflect the whole and/or partial symmetries.

Referring to FIG. 12, the blank 305 comprises a base panel 310 foldably connected to first and second side panels 320 at longitudinal fold lines 322, first and second end panels 330 foldably connected to the base panel 310 at transverse fold lines 332, and a cover panel 340 foldably connected to one side panel 320 at a longitudinal fold line 342. An adhesive flap 324 may be foldably connected to each end of each side panel 320 at an oblique fold line 326. The ends of the adhesive flaps 324 are separated from adjacent end panels 330 at oblique breachable lines of disruption 328, which may be, for example, cuts.

The cover panel 340 includes a closure projection 352 projecting from one end of the panel 340 and having a longitudinal crease 354 at its base. The closure projection 352 includes a neck portion 356 and a pair of outwardly extending shoulders 357. In the erected carton 395 (FIG. 14), the pair of outwardly extending shoulders 357of the closure projection 352 are sized to be received by a pair of inwardly extending projections 358 in a closure aperture 350 formed in the opposite side panel 320.

In the exemplary embodiment, the fold lines 322, 326, 332, 342 are crease lines, although other lines of disruption in the blank may be used. The closure aperture 350 is struck from the edge of the panel 320.

An exemplary method of erection of the carton blank 305, into the carton 395, and closure of the carton 395 will now be discussed with reference to FIG. 12-14.

Figure 13:
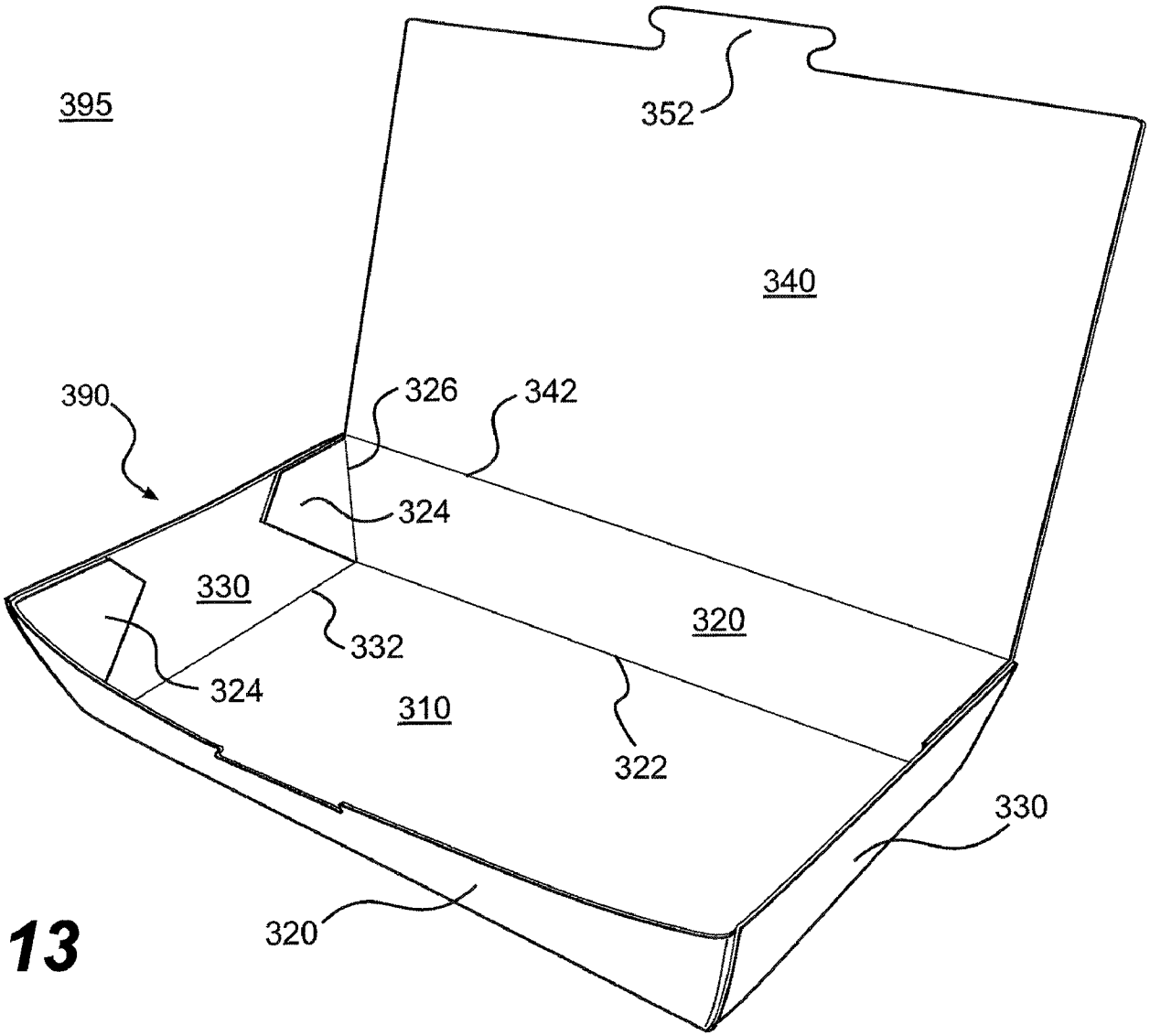
FIG. 13 illustrates the erected fourth carton embodiment in its opened configuration.

Referring to FIGS. 12 and 13, the carton 395 may be erected from the blank 305 by folding the adhesive flaps 324 inwardly at the oblique fold lines 326, folding the side panels 320 upwardly about the longitudinal fold lines 322, and folding the end panels 330 upwardly about the transverse fold lines 332. The exterior sides of the adhesive flaps 324 can then be glued or otherwise adhered or secured to the interior sides of adjacent end panels 330.

FIG. 13 illustrates the erected carton 395 in its upright, opened state. The panels 310, 320, 330 form a receptacle or tray portion 390 of the carton 395. The panels 320, 330 may extend upwardly obliquely (i.e., at a non-vertical orientation) with respect to the base panel 310, so that a surface area of the top of the receptacle 390 is larger than that of the base panel 310. When closing the carton 395, the longitudinal fold line 342 acts as a hinge or pivot line for the cover panel 340. The open top of the tray portion 390 of the carton 395 is covered by pivoting the cover panel 340 downward about the transverse hinge line 342.

Figure 14:
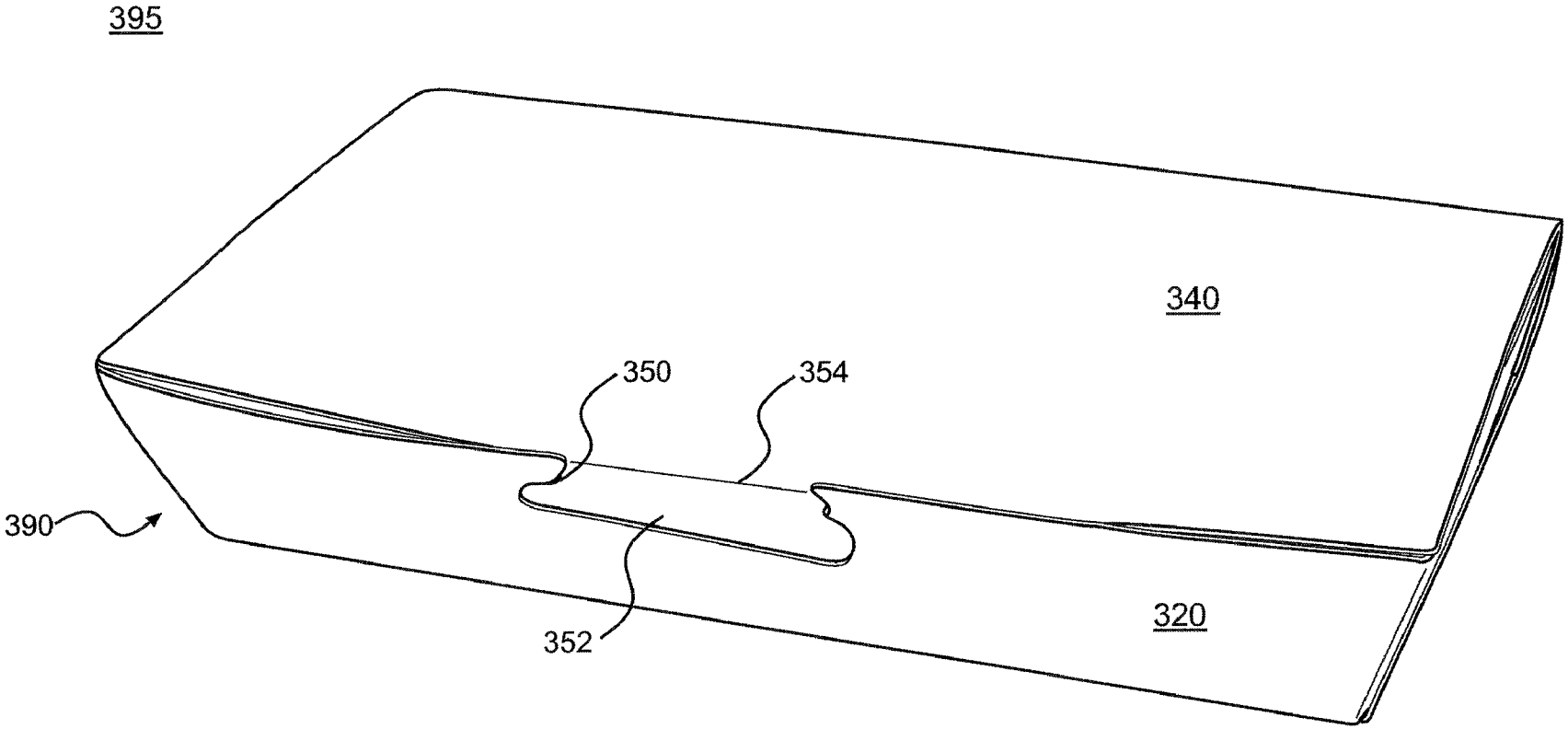
FIG. 14 illustrates the fourth carton embodiment in its closed configuration.

Referring to FIG. 14, the carton 395 is secured in its closed configuration by pressing the closure projection 352 into the closure aperture 350 struck from the edge of the side panel 320. The carton 395 may be subsequently opened and reclosed by disengaging and reengaging the closure projection 352 with the closure aperture 350.

According to the above-described embodiments, the cartons may be formed from one-piece blanks. The cartons can be closed and remain in secured, closed configurations. The cover panels allow for easy opening, filling, closing and reclosing of the cartons. The cartons can be stacked when in their open, erected configurations, and when in their closed configurations. The tray or receptacle portion of the cartons have a larger opening at the tops of the receptacle portions, allowing product to be easily loaded into and removed from the cartons.

In the exemplary embodiments discussed above, the exemplary blanks may be formed from, for example, clay coated newsprint (CCN), solid unbleached sulfate board (SUS), and other materials. In general, the blanks may be constructed from paperboard having a caliper such that it is heavier and more rigid than ordinary paper. The blanks can also be constructed of other materials, such as cardboard, or any other material having properties suitable for enabling the basket carrier to function at least generally as described above.

The exemplary blanks can be coated with, for example, a clay coating. The clay coating may then be printed over with product, advertising, nutritional, and other information or images. The blanks may then be coated with a varnish to protect information printed on the blank. The blanks may also be coated with, for example, a moisture barrier layer, on either or both sides of the blanks. Coatings such as polyethylene, polyester, etc. may also be used.

Microwave interactive materials (e.g., microwave susceptor materials) may be placed on or over one or panels of the blanks. The blanks can also be laminated to or coated with one or more sheet-like materials at selected panels or panel sections.

In accordance with the exemplary embodiments, a fold line can be any substantially linear, although not necessarily straight, form of disruption or weakening in the blank that facilitates full or partial bending or folding therealong. More specifically, but not for the purpose of narrowing the scope of the present invention, examples of fold lines include: score lines; crease lines; cut-crease lines; cut-score lines; cut-space lines; and various overlapping and/or sequential combinations of these features.

In the present specification, a "panel" or "flap" need not be flat or otherwise planar. A "panel" or "flap" can, for example, comprise a plurality of interconnected generally flat or planar sections.

For purposes of the description presented herein, the term "line of disruption" can be used to generally refer to, for example, a cut line, a score line, a crease line, a tear line, or a fold line (or combinations thereof) formed in a blank.

The term "foldably" is used to describe general folding or bending between connected panels. The term does not imply the ability to fold to a large degree, such as, for example, a ninety degree fold. Further, the description "folded flat" does not require an exact 180 degree fold, and allows for bowing, etc. between the folded panels of the blank.

The term "line" as used herein includes not only straight lines, but also other types of lines such as curved, curvilinear or angularly displaced lines, and interrupted lines.

The above embodiments may be described as having one or more panels adhered together by glue. In this specification, the term "glue" is intended to encompass all manner of adhesives commonly used to secure paperboard or similar materials together.

The description is not intended to limit the invention to the form disclosed herein. Also, it is intended that the appended claims be construed to include alternative embodiments, not explicitly defined in the detailed description.

What is claimed is:

1. A carton, comprising:

a base panel;

a first side panel and a second side panel extending upwardly from a first pair of opposite edges of the base panel;

a first end panel and a second end panel extending upwardly from a second pair of opposite edges of the base panel, the first end panel and the second end panel being respectively located at opposite first and second ends of the carton;

a first cover panel and a second cover panel respectively joined to the first side panel and the second side panel, each of the first cover panel and the second cover panel having a linear peripheral edge extending substantially completely thereacross, each of the first cover panel and the second cover panel substantially extending from the first end of the carton to the second end of the carton, so that each of the linear peripheral edges extends substantially to each of the first and second ends of the carton, wherein each of the first cover panel and the second cover panel has opposite first and second ends respectively located substantially at the first and second ends of the carton;

a first upper end flap connected by a fold line to the first end of the first cover panel;

a second upper end flap connected by a fold line to the second end of the first cover panel;

a third upper end flap connected by a fold line to the first end of the second cover panel;

a fourth upper end flap connected by a fold line to the second end of the second cover panel;

a first closure projection extending from the linear peripheral edge of the first cover panel, the first closure projection including a cut adjacent to and co-extensive with the linear peripheral edge of the first cover panel, the cut being more proximate to the first end panel than the second end panel;

a second closure projection extending from the linear peripheral edge of the second cover panel, the second closure projection including a cut adjacent to and co-extensive with the linear peripheral edge of the second cover panel, the cut of the second closure projection being more proximate to the second end panel than the first end panel; and the carton being configurable into a closed configuration in which the linear peripheral edge of the first cover panel extends along and is in substantially close proximity to the linear peripheral edge of the second cover panel, and the first, second, third and fourth upper end flaps are respectively in substantially close proximity to the first and second end panels, and wherein the first closure projection and the second closure projection are operative for engaging one another along the respective cuts to secure the carton in the closed configuration, wherein the first side panel is a first lower side panel, a first upper side panel is positioned between, and joined by respective fold lines to each of, the first lower side panel and the first cover panel, the second side panel is a second lower side panel, and a second upper side panel is positioned between, and joined by respective fold lines to each of, the second lower side panel and the second cover panel.

2. The carton of claim 1, wherein at least one of the first closure projection and the second closure projection is substantially semi-circular in shape.

3. The carton of claim 1, wherein the first end panel and the second end panel are joined to the respectively adjacent first lower side panel and second lower side panel by respective adhesive flaps.

4. The carton of claim 1, wherein the base panel, first lower side panel, second lower side panel, first end panel, and second end panel form a receptacle of the carton, an uppermost portion of the receptacle having a larger area than the base panel.

5. The carton of claim 1, wherein the first lower side panel, second lower side panel, first end panel, and second end panel extend upwardly and obliquely from the base panel.

6. The carton of claim 1, wherein the first lower side panel, second lower side panel, first end panel, and second end panel have a height, and the base panel has a length and a width, at least one of the length and the width of the base panel being greater than the height of the first lower side panel, second lower side panel, first end panel, and second end panel.

7. The carton of claim 1, wherein the carton is formed from a one-piece blank.

8. The carton of claim 1, wherein the first closure projection is adapted for extending through the cut of the second closure projection, and the second closure projection is adapted for extending through the cut of the first closure projection, so that the first and second closure projections engage one another along the respective cuts to releasably secure the first and second cover panels in the closed configuration.

9. The carton of claim 1, wherein the first closure projection extends through the cut of the second closure projection, and the second closure projection extends through the cut of the first closure projection, so that the first and second closure projections are engaged to one another along the respective cuts and the first and second cover panels are secured to one another in the closed configuration.

10. The carton of claim 1, wherein each of the first upper side panel and the second upper side panel has opposite first and second ends respectively located substantially at the first and second ends of the carton, and the carton comprises:

a first attachment flap connected to and extending from the first end of the first upper side panel, the first attachment flap and the first upper end flap being attached to one another and overlapped with respect to one another;

a second attachment flap connected to and extending from the second end of the first upper side panel, the second attachment flap and the second upper end flap being attached to one another and overlapped with respect to one another;

a third attachment flap connected to and extending from the first end of the second upper side panel, the third attachment flap and the third upper end flap being attached to one another and overlapped with respect to one another; and a fourth attachment flap connected to and extending from the second end of the second upper side panel, the fourth attachment flap and the fourth upper end flap being attached to one another and overlapped with respect to one another.

* * * * *